US010415329B2

(12) United States Patent
Nonmacher et al.

(10) Patent No.: US 10,415,329 B2
(45) Date of Patent: Sep. 17, 2019

(54) SUBSEA SYSTEM WITH LANDING INDICATION

(71) Applicant: OneSubsea IP UK Limited, London (GB)

(72) Inventors: Joseph B. Nonmacher, Houston, TX (US); Parth D. Pathak, Houston, TX (US); Lilian Boukheir, Katy, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 15/813,460

(22) Filed: Nov. 15, 2017

(65) Prior Publication Data

US 2019/0145196 A1 May 16, 2019

(51) Int. Cl.

| | |
|---|---|
| ***E21B 19/16*** | (2006.01) |
| ***E21B 33/043*** | (2006.01) |
| ***E21B 34/04*** | (2006.01) |
| ***E21B 47/00*** | (2012.01) |
| ***E21B 47/10*** | (2012.01) |

(52) U.S. Cl.

CPC ..... *E21B 19/165* (2013.01); *E21B 34/04* (2013.01); *E21B 47/0001* (2013.01); *E21B 47/1025* (2013.01)

(58) Field of Classification Search

CPC ..... E21B 19/165; E21B 33/043; E21B 34/04; E21B 47/0001; E21B 47/1025

See application file for complete search history.

(56) References Cited

U.S. PATENT DOCUMENTS

| | | | | |
|---|---|---|---|---|
| 4,300,637 | A * | 11/1981 | Valka | E21B 33/0355 166/336 |
| 4,300,750 | A * | 11/1981 | Valka | F16K 37/0066 251/323 |
| 4,862,426 | A * | 8/1989 | Cassity | E21B 33/0355 166/335 |
| 6,725,924 | B2 * | 4/2004 | Davidson | E21B 33/0355 166/250.01 |
| 8,322,428 | B2 * | 12/2012 | Jennings | E21B 47/09 166/250.01 |
| 8,567,493 | B2 * | 10/2013 | June | E21B 23/00 166/208 |
| 2012/0292035 | A1 * | 11/2012 | Fenwick | E21B 33/043 166/336 |

FOREIGN PATENT DOCUMENTS

| | | | | |
|---|---|---|---|---|
| WO | WO-2017150982 | A1 * | 9/2017 | E21B 23/01 |

* cited by examiner

*Primary Examiner* — Matthew R Buck

(74) *Attorney, Agent, or Firm* — Brandon S. Clark

(57) ABSTRACT

A technique facilitates landing of a subsea component, e.g. a tubing hanger, by utilizing a poppet valve to provide an indication of proper landing. The poppet valve is combined with the tubing hanger or other subsea component and oriented to engage a corresponding landing surface. A pressure line is routed to the poppet valve, and the poppet valve is biased to an open flow position with respect to the pressure line during deployment. If the subsea component is properly landed, the corresponding landing surface is able to shift the poppet valve to a closed position. The closed position may be verified via pressure testing through the pressure line.

19 Claims, 5 Drawing Sheets

SUBSEA SYSTEM WITH LANDING INDICATION

BACKGROUND

Hydrocarbon fluids such as oil and natural gas are obtained from a subterranean geologic formation, referred to as a reservoir, by drilling a well that penetrates the hydrocarbon-bearing geologic formation. In subsea applications, the well is drilled at a subsea location and various types of equipment are used to complete the well and enable production of the hydrocarbon fluids. In some operations, a subsea wellhead assembly is positioned over the well and may include several types of components and systems. For example, the subsea wellhead assembly may comprise a tubing head spool structured to receive a tubing hanger. Sometimes difficulties may arise in determining whether the tubing hanger has been properly landed in the tubing head spool.

SUMMARY

In general, a system and methodology are provided for facilitating landing of a subsea component, e.g. a tubing hanger, by utilizing a poppet valve to provide an indication of proper landing. The poppet valve is combined with the tubing hanger or other subsea component and oriented to engage a corresponding landing surface. A pressure line is routed to the poppet valve, and the poppet valve is biased to an open flow position with respect to the pressure line during deployment. If the subsea component is properly landed, the corresponding landing surface is able to shift the poppet valve to a closed position. The closed position may be verified via pressure testing through the pressure line.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for facilitating landing of a subsea component by utilizing a poppet valve to provide an indication of proper landing. By way of example, the subsea component may be in the form of a tubing hanger which includes the poppet valve in a recess. Depending on the application, the poppet valve may be combined with the tubing hanger or other subsea component and oriented to engage a landing surface, e.g. a landing surface of a tubing head spool.

A pressure line is routed to the poppet valve through, for example, the subsea component. According to an embodiment, the pressure line is routed through the tubing hanger to the recess containing the poppet valve in a manner such that the poppet valve may be used to control flow through the pressure line. During deployment of the subsea component (prior to landing), the poppet valve is biased to an open flow position with respect to fluid flow through the pressure line and poppet valve. If the subsea component is properly landed, a landing surface is able to shift the poppet valve to a closed position. The closed position (and thus proper landing) may be verified via pressure testing through the pressure line.

Figure 1:
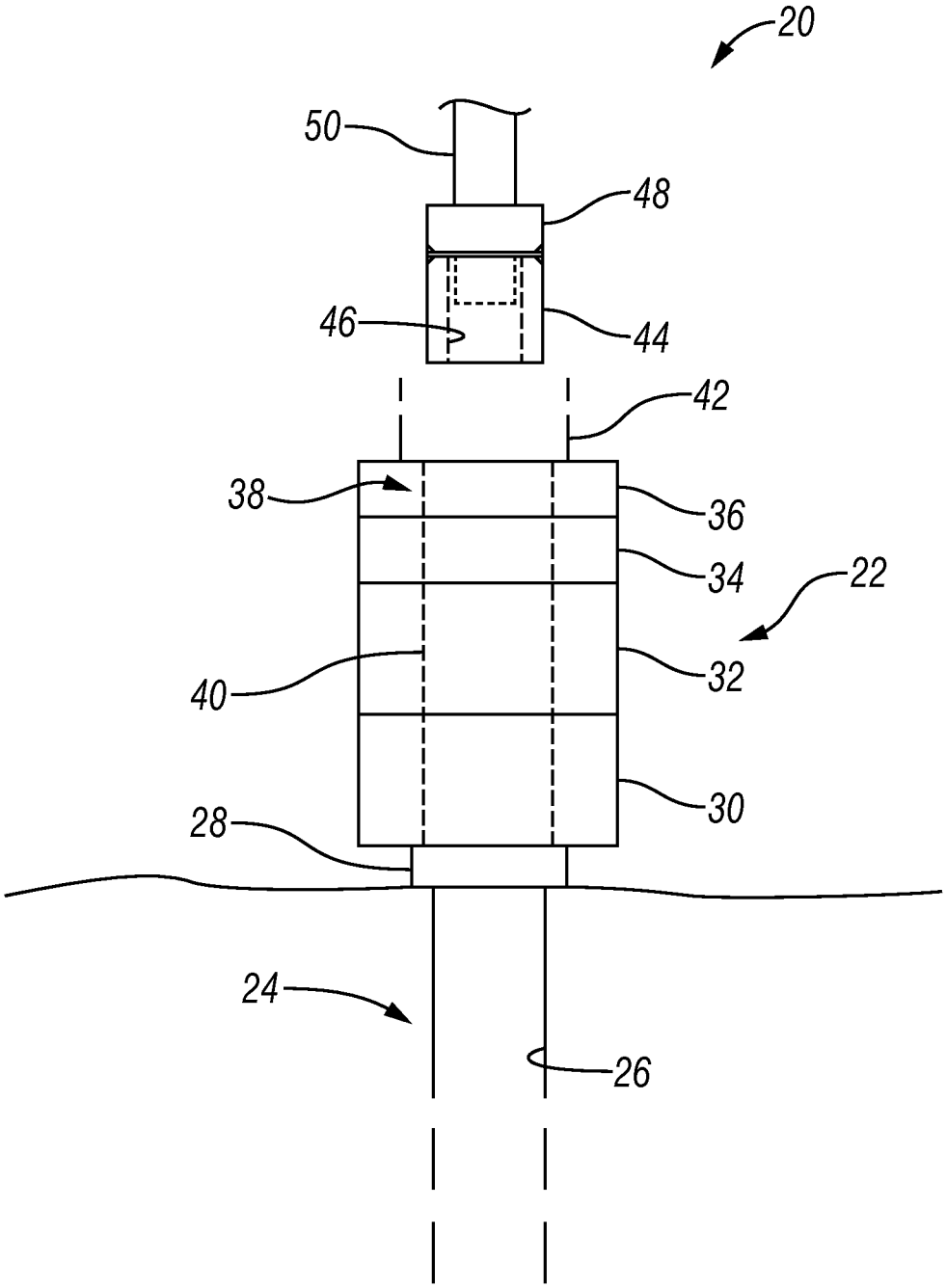
FIG. 1 is a schematic illustration of an example of a subsea well system during a subsea component landing operation, according to an embodiment of the disclosure.

Referring generally to FIG. 1, an example of a subsea well system 20 is illustrated. In this embodiment, the subsea well system 20 comprises a subsea installation 22, e.g. a wellhead assembly, positioned over a well 24 comprising a wellbore 26. Depending on the parameters of a given operation, the subsea installation 22 may comprise a variety of components.

By way of example, the subsea installation 22 may be in the form of a wellhead assembly having a wellhead hub 28 combined with a casing spool 30 and a tubing head spool 32. Other components may include a production tree 34 and a blowout preventer 36. A passage 38, referred to as a bore, extends down through the subsea installation 22 to enable interaction with wellbore 26. Individual components may include sections of the passage 38, and one example is a tubing head spool bore 40 of tubing head spool 32. In some embodiments, a riser 42 may be used and may extend up to a surface facility, such as a surface vessel.

According to the embodiment illustrated, a subsea component, e.g. a tubing hanger, 44 having a hanger bore 46 may be being deployed down toward tubing head spool 32. It should be noted the subsea component 44 may comprise components other than a tubing hanger in the other components may similarly be are landed in corresponding components or assemblies. However, the tubing hanger 44 is described herein to facilitate explanation. If riser 42 is employed, the tubing hanger 44 may be deployed down through the riser 42 toward landing in the tubing head spool 32. In this example, the tubing hanger 44 is deployed by a tubing hanger running tool 48 coupled with a conveyance 50, such as a drill string or other tubing.

The tubing hanger running tool 48 is releasably coupled with the tubing hanger 44 and may be released and retrieved upon verification of proper landing of the tubing hanger 44 in tubing head spool 32 as described in greater detail below. It should again be noted that although landing of the tubing hanger 44 in tubing head spool 32 has been described for purposes of explanation, the landing verification system and methodology described herein may be used with a variety of other types of subsea components landed in corresponding equipment. The other types of subsea components may similarly be delivered through a riser or through open water depending on the parameters of a given operation.

Figure 2:
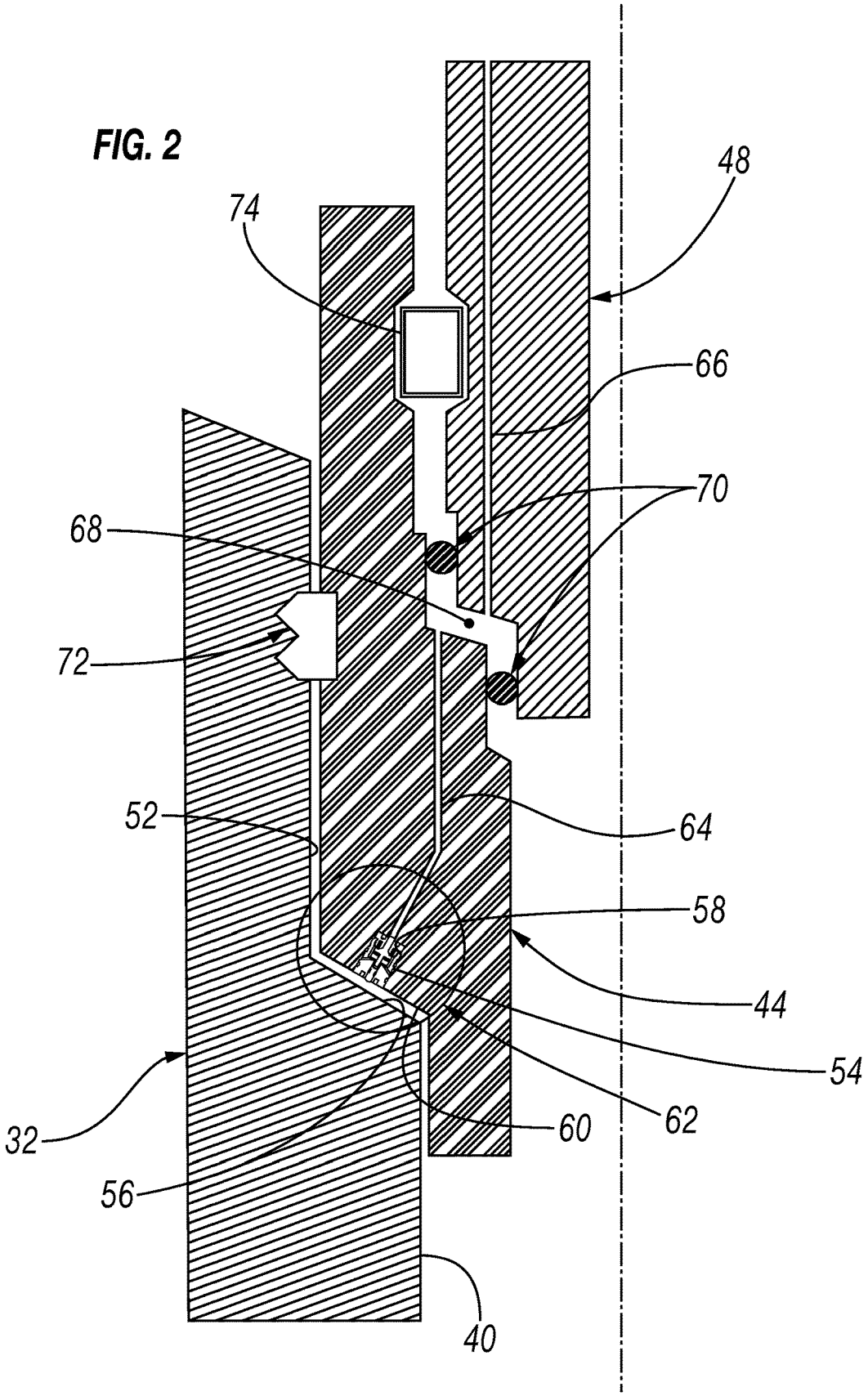
FIG. 2 is a cross-sectional illustration of an example of a portion of a tubing hanger running tool landing a tubing hanger in a tubing head spool, according to an embodiment of the disclosure.

With additional reference to FIG. 2, an embodiment of the tubing hanger 44 landed in tubing head spool 32 via tubing hanger running tool 48 is illustrated. In this example, the tubing hanger 44 is sized for reception in a receptacle 52 of tubing head spool 32. Receptacle 52 may be part of or formed along tubing head spool bore 40. The tubing hanger 44 has a poppet valve 54 oriented for engagement with a landing surface 56 of tubing head spool 32.

The poppet valve 54 may be mounted in a recess 58 formed within tubing hanger 44 proximate a tubing hanger landing surface 60. The landing surface 56 and corresponding tubing hanger landing surface 60 form a landing surface interface 62 which is properly engaged, e.g. sealably engaged, when tubing hanger 44 is properly landed in tubing head spool 32.

The tubing hanger 44 also comprises a pressure line 64 routed to the poppet valve 54. For example, the pressure line 64 may be placed in fluid communication with recess 58 and thus with poppet valve 54. When poppet valve 54 is in an open flow position, fluid is able to flow along the pressure line 64 and through poppet valve 54. However, when poppet valve 54 is in a closed flow position, flow along pressure line 64 and through poppet valve 54 is blocked. Prior to successfully landing tubing hanger 44 in tubing head spool 32, the poppet valve 54 is biased to an open flow position to allow fluid flow along the pressure line 64 and through the poppet valve 54.

According to the embodiment illustrated, the pressure line 64 may be placed in communication with a suitable pressure source to enable pressure testing for verification of proper landing. For example, the pressure line 64 be placed in fluid communication with a corresponding pressure line 66 routed through tubing hanger running tool 48 via a gallery region 68 located between the tubing hanger 44 and the tubing hanger running tool 48. The gallery 68 may be sealed via seals 70, e.g. a pair of elastomeric seals, positioned between the tubing hanger running tool 48 and the tubing hanger 44. It should be noted other methods of providing a fluid coupling between the tubing hanger running tool 48 and the tubing hanger 44 also may be employed. For example, hydraulic couplers may be used to connect pressure line 64 and corresponding pressure line 66.

The corresponding pressure line 66 may be routed to a surface pressure source or other suitable pressure source so that pressure tests may be administered by applying pressure down through corresponding pressure line 66, pressure line 64, and to poppet valve 54. In some embodiments, the tubing hanger 44 may comprise a latch mechanism 72 by which the tubing hanger 44 is latched into engagement with tubing head spool 32. Additionally, the tubing hanger running tool 48 may comprise a releasable latch mechanism 74 by which the tubing hanger running tool 48 is releasably attached to tubing hanger 44 to enable deployment and landing of the tubing hanger 44 with respect to tubing head spool 32.

Figure 4:
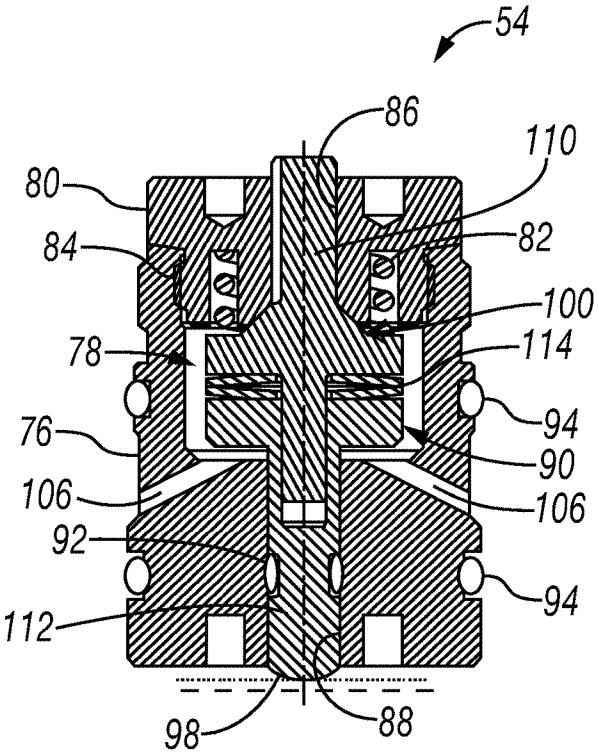
FIG. 4 is a cross-sectional illustration of an example of a poppet valve in a closed flow position following proper landing, according to an embodiment of the disclosure.
Figure 3:
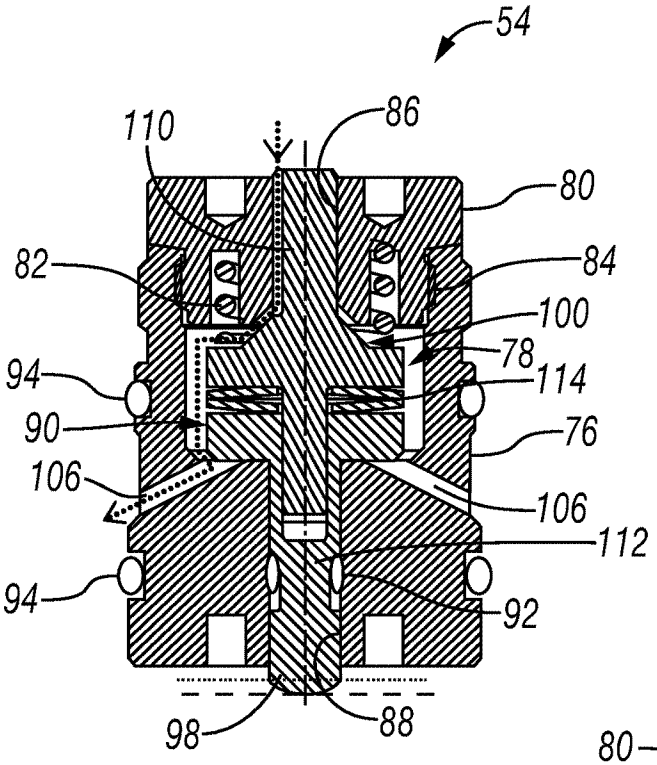
FIG. 3 is a cross-sectional illustration of an example of a poppet valve in an open flow position prior to landing, according to an embodiment of the disclosure.

Referring generally to FIGS. 3 and 4, an embodiment of poppet valve 54 is illustrated. In this example, the poppet valve 54 may be constructed as a stand-alone assembly which can be installed into the tubing hanger 44, e.g. into tubing hanger recess 58, as a single unit. By way of example, the poppet valve 54 may comprise a valve body 76 and a poppet stem 78 movable to an open flow position to allow fluid flow (see FIG. 3) and to a closed flow position to block fluid flow (see FIG. 4).

The poppet valve 54 also may comprise a retainer cap 80 and a spring 82 positioned to bias the poppet stem 78 to the open flow position illustrated in FIG. 3. For example, the spring 82 may be in the form of a coil spring compressed between the retainer cap 80 and the poppet stem 78 so as to bias the poppet stem 78 toward the open flow position. The retainer cap 80 may be secured to the valve body 76 via a threaded engagement 84 or other suitable attachment mechanism.

The poppet stem 78 may be slidably received in a passage/bore 86 of retainer cap 80 and in a corresponding passage/bore 88 of valve body 76. An expanded portion 90 of the poppet stem 78 is captured between portions of the valve body 76 and the retainer cap 80. A seal 92, e.g. an elastomeric O-ring seal, may be positioned between the poppet stem 78 and valve body 76 along the passage/bore 88. Additionally, an external seal 94 or a plurality of external seals 94, e.g. elastomeric O-ring seals, may be positioned along the exterior of the poppet valve 54 and oriented for engagement with a corresponding wall surface 96 which defines the recess 58 (see FIG. 6). The seals 92, 94 prevent unwanted loss of pressure past the poppet valve 54 during, for example, pressure testing to verify proper landing of the tubing hanger 44 in tubing head spool 32.

As illustrated, poppet stem 78 may comprise a portion 98 which extends from the valve body 76. The portion 98 is oriented for engagement with the landing surface 56 such that landing of the tubing hanger 44 in the tubing head spool 32 causes the landing surface 56 to engage portion 98 and to shift the poppet stem 78. When the landing is properly performed, the poppet stem 78 is shifted to the closed flow position, illustrated in FIG. 4, thus blocking flow through the poppet valve 54.

Figure 5:
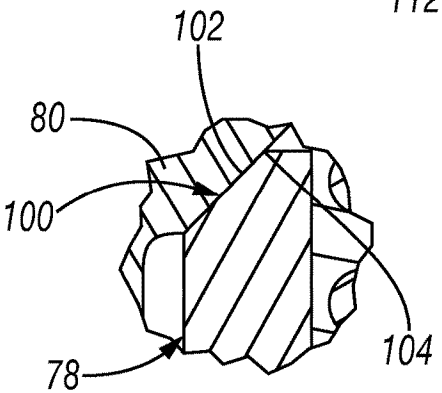
FIG. 5 is a cross-sectional illustration of an example of a closed valve seat blocking flow through the poppet valve when the poppet valve is in the closed flow position, according to an embodiment of the disclosure.

By way of example, the poppet stem 78 may have a conical region 100, e.g. a cone, having a seating surface 102 which seats against a corresponding seating surface 104, as further illustrated in FIG. 5, when the poppet valve 54 is shifted to the closed flow position. In the embodiment illustrated, the corresponding seating surface 104 may be formed in retainer cap 80 and oriented for engagement with seating surface 102. However, the corresponding seating surface 104 may be located on valve body 76 or at other suitable locations.

During pressure testing, the seals 92, 94 work with the engaged seating surfaces 102, 104 to hold against pressure applied in pressure line 64. When poppet valve 54 is in the open flow position, pressure is not held and fluid flow is allowed to move past the cone 100 between seating surfaces 102 and 104. In the example illustrated, this open position fluid flow is allowed to flow past the poppet stem 78 and through a flow passage or passages 106 formed in poppet valve 54, e.g. through valve body 76. The flow passage(s) 106 allow the fluid to exit the tubing hanger 44.

Figure 6:
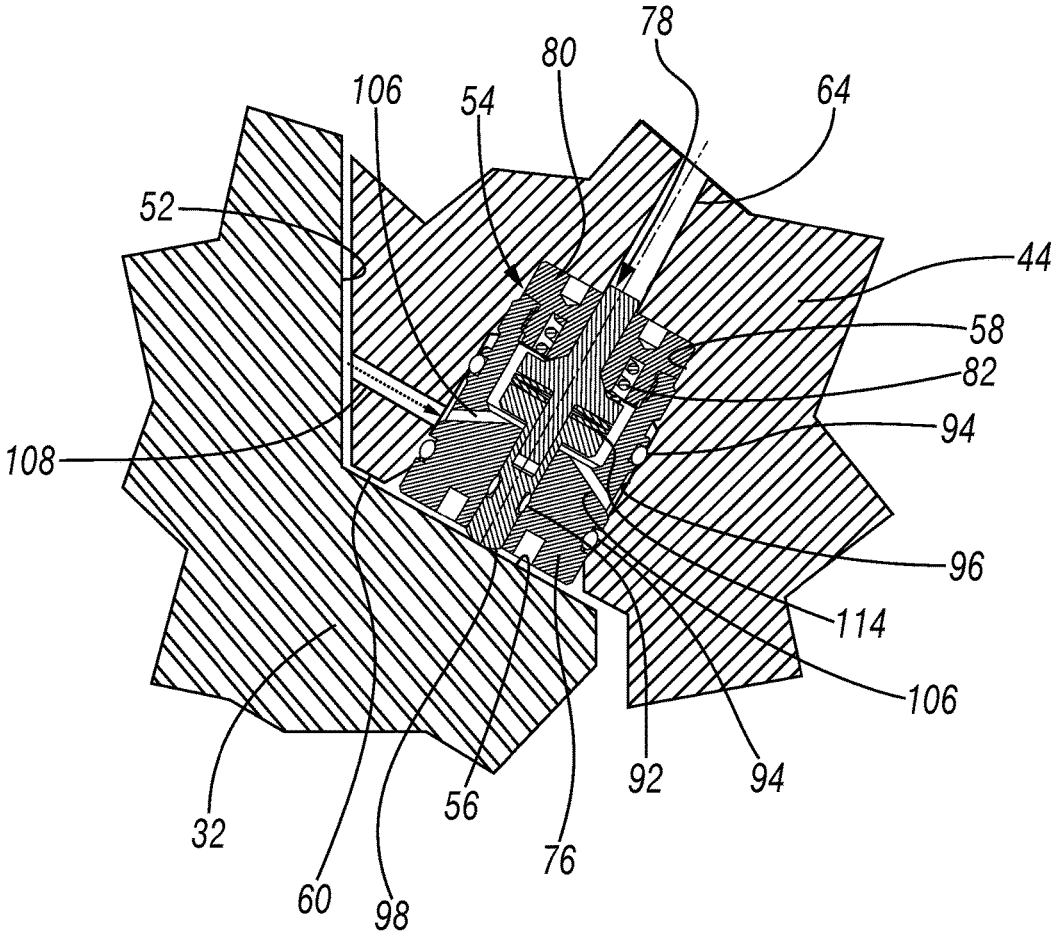
FIG. 6 is a cross-sectional illustration of an example of a poppet valve positioned in a subsea component being landed against a corresponding landing surface, according to an embodiment of the disclosure.

According to an embodiment, the flow passages 106 may be routed between a pair of the external seals 94 and through a side of the valve body 76. In this type of arrangement, the flow passages 106 may be placed in fluid communication with a corresponding flow passage 108 routed through a portion of the tubing hanger 44, as illustrated in FIG. 6.

In some embodiments, the poppet stem 78 may be constructed as a two-piece poppet stem having a first stem piece 110 separated from a second stem piece 112 via a spring member 114. The spring member 114 may be in the form of Belleville washers or other suitable spring members which resist but allow some movement between the first and second stem pieces 110, 112. The use of spring member 114 between stem pieces 110, 112 accommodates part tolerances and debris without limiting the sealing capabilities of the seating surfaces 102 and 104. This approach adds flexibility to the structure and ensures the poppet seal is maintained in spite of differences in tolerances or debris on, for example, the landing surface 56.

Figure 7:
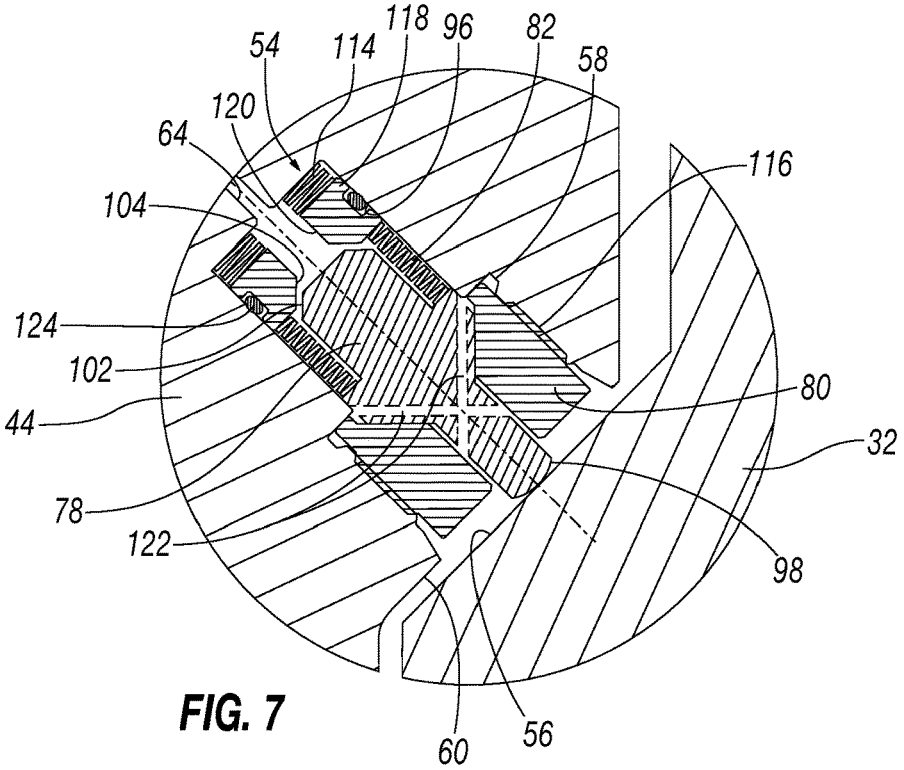
FIG. 7 is a cross-sectional illustration of another example of a poppet valve positioned in a subsea component being landed against a corresponding landing surface, according to an embodiment of the disclosure.
Figure 8:
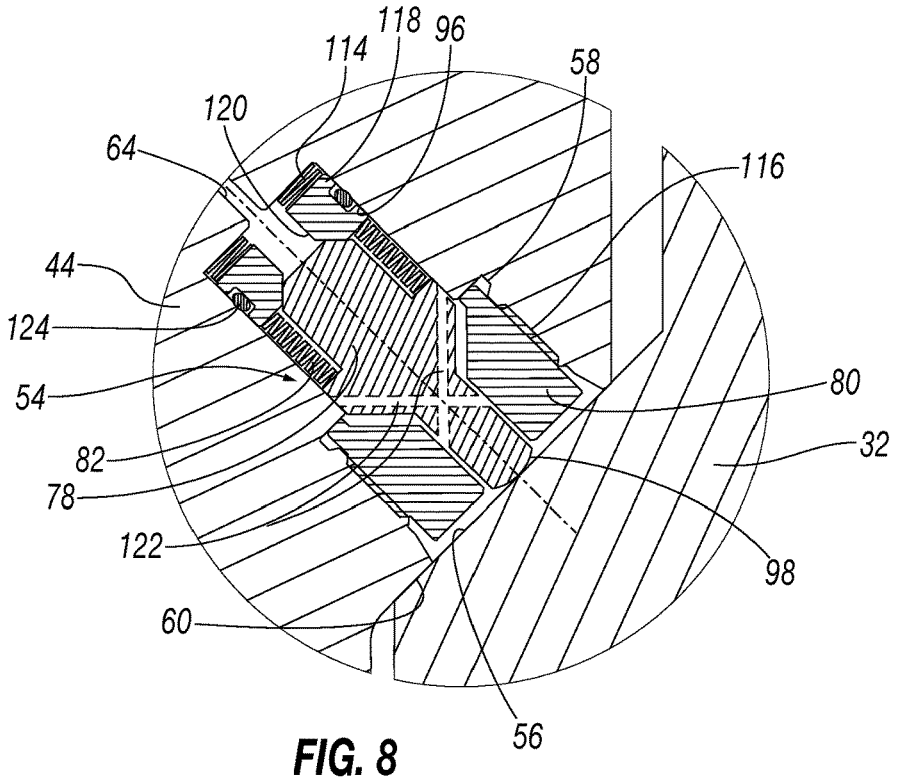
FIG. 8 is a cross-sectional illustration similar to that of FIG. 7 but showing the poppet valve in a closed flow position following proper landing, according to an embodiment of the disclosure.

Referring generally to FIGS. 7 and 8, another embodiment of poppet valve 54 is illustrated. In this example, components of the poppet valve 54 are arranged such that the retainer cap 80 holds the components of poppet valve 54 in recess 58. For example, the retainer cap 80 may be secured to the subsea component/tubing hanger 44 via a threaded engagement 116 or by other suitable fastening mechanisms. The poppet stem 78 is again spring biased via spring 82 towards a normally open position, as illustrated in FIG. 7. In this position, the seating surface 102 remains unseated with respect to corresponding seating surface 104.

According to this embodiment, the corresponding seating surface 104 is located along a back ring 118. The back ring 118 may comprise a flow passage 120 to accommodate flow between pressure line 64 and flow passages 122 through poppet stem 78. The back ring 118 may be mounted against spring member 114 to similarly provide flexibility for varying tolerances and debris. A seal 124, e.g. an O-ring seal, may be positioned between back ring 118 and the wall surface 96 defining recess 58.

When the portion 98 of poppet stem 78 sufficiently engages landing surface 56 during proper landing of tubing hanger 44 in tubing head spool 32, the poppet stem 78 is shifted to the closed flow position as illustrated in FIG. 8. In this position, seating surface 102 is sealingly engaged with corresponding seating surface 104 to block flow from pressure line 64, thus enabling pressure testing to verify proper landing. In the configuration illustrated in FIGS. 7 and 8, the poppet valve 54 utilizes a single piece poppet stem 78 which is capable of bleeding pressure through itself without the addition of side porting and external seals.

In tubing hanger applications, the various embodiments of poppet valve 54 are each able to provide an indication when the tubing hanger 44 has properly, e.g. completely, landed in the tubing head spool 32. When the tubing hanger 44 is properly landed, the poppet valve 54 is shifted from an open flow position to a closed flow position able to hold hydraulic pressure. As a result, pressure testing may be applied via pressure line 64 to verify proper landing without a visual indication.

Furthermore, the poppet valve 54 is useful in positively confirming proper landing of the tubing hanger 44 prior to bore pressure tests and prior to locking of the tubing hanger 44 to the tubing head spool 32. Additionally, this type of verification system enables venting of the gallery 68 during running of the tubing hanger 44 down to the tubing head spool 32. The ability to hold pressure in the gallery 68 due to the closed poppet valve 54 also can be useful when the tubing hanger running tool 48 is recovered and re-run down to the tubing hanger 44. The closed poppet valve 54 enables pressure testing following stabbing of the tubing hanger running tool 48 into the tubing hanger 44. Furthermore, the normally open-position poppet valve 54 does not interfere with or build up/trap pressure during emergency unlatching and blowout preventer tests.

It should be noted this type of landing verification system may be used for a variety of components, including subsea equipment run through a riser and landed in a region which is not amenable to visual verification. The poppet valve based landing verification system also may be used with various communication systems and control systems to similarly verify when a desired landing has been achieved.

The poppet valve 54 may be constructed in various configurations to enable shifting from an open flow position to a closed flow position upon proper landing. Additionally, the poppet valve 54 may be used in a variety of tubing hangers 44 and other types of subsea components which are landed in corresponding equipment. The pressure testing may be conducted through various pressure passages routed down to the poppet valve 54. Depending on the component configuration, the poppet valve 54 may be mounted in a variety of recesses or along a variety of other structures to enable engagement with a desired landing surface.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a subsea well application, comprising:

a tubing head spool having a receptacle and a landing surface; and a tubing hanger sized for receipt in the receptacle of the tubing head spool, the tubing hanger having: a poppet valve oriented for engagement with the landing surface; and a pressure line routed to the poppet valve, the poppet valve being biased by a first spring member to an open flow position to allow fluid flow along the pressure line and through the poppet valve prior to landing the poppet valve against the landing surface, the poppet valve further comprising a poppet stem and a second spring member positioned to accommodate part tolerances and debris when the poppet stem of the poppet valve is landed against the landing surface in a manner which causes the poppet valve to sealably close and block further fluid flow through the poppet valve, the poppet stem maintaining contact with the landing surface after being landed.

2. The system as recited in claim 1, wherein the tubing hanger comprises a tubing hanger landing surface oriented for engagement with the landing surface of the tubing head spool.

3. The system as recited in claim 1, further comprising a latch mechanism between the tubing head spool and the tubing hanger.

4. The system as recited in claim 1, further comprising a tubing hanger running tool releasably coupled to the tubing hanger.

5. The system as recited in claim 1, wherein the poppet valve comprises a valve body and a retainer cap, the first spring member being positioned to bias the poppet stem to the open flow position.

6. The system as recited in claim 5, wherein the poppet valve is received in a recess formed in the tubing hanger, the recess being in fluid communication with the pressure line.

7. The system as recited in claim 6, wherein the poppet valve comprises at least one elastomeric seal positioned to seal between the poppet valve and a wall surface forming the recess.

8. The system as recited in claim 7, wherein the poppet stem comprises a first stem piece separated from a second stem piece via the second spring member.

9. The system as recited in claim 5, wherein the poppet stem comprises a cone having a seating surface which seats against the retainer cap when the poppet valve is shifted to a closed flow position blocking fluid flow therethrough.

10. A system, comprising:

a subsea component having a pressure line extending to a recess and a poppet valve disposed in the recess, the poppet valve having a valve body with a flow passage and a poppet stem shiftable between a closed position blocking flow along the flow passage and an open position allowing flow from the pressure line through the flow passage, the poppet stem being biased to the open position by a spring, the poppet stem further comprising a portion extending from the valve body to enable shifting of the poppet stem to the closed position when the portion of the poppet stem is landed against a landing surface of a corresponding subsea component with sufficient force exerted on the portion to overcome the spring, the poppet stem remaining in the closed position via continued contact between the portion and the landing surface; and a running tool releasably coupled to the subsea component, the running tool having a corresponding pressure line placed in fluid communication with the pressure line via a gallery region established between the running tool and the subsea component and sealed by a plurality of seals until the running tool is released from the subsea component.

11. The system as recited in claim 10, wherein the corresponding subsea component being in the form of a tubing head spool having the landing surface oriented to engage the portion of the poppet stem when the subsea component is landed in the tubing head spool, the subsea component being in the form of a tubing hanger.

12. The system as recited in claim 10, wherein the poppet valve comprises an elastomeric seal positioned to form a seal between the poppet valve and a wall surface forming the recess.

13. The system as recited in claim 10, wherein the poppet valve comprises a plurality of elastomeric seals positioned to form a seal between the poppet valve and a wall surface forming the recess.

14. The system as recited in claim 10, wherein the poppet stem comprises a first stem piece separated from a second stem piece via a spring member.

15. The system as recited in claim 10, wherein the poppet stem comprises a conical seating surface which moves against a corresponding seating surface when the poppet valve is shifted to the closed position.

16. A method for use in a subsea well application, comprising:

locating a poppet valve in a tubing hanger having a pressure line extending to the poppet valve;

maintaining the poppet valve in an open flow position while the tubing hanger is moved toward a tubing head spool;

landing the tubing hanger in the tubing head spool;

using a landing surface in the tubing head spool to shift a poppet stem of the poppet valve until the poppet valve is in a closed flow position;

maintaining contact between the poppet stem and the landing surface;

while maintaining contact between the poppet stem and the landing surface, accommodating part tolerances and debris to ensure closure of the poppet valve without incurring damage; and pressuring up the pressure line to test whether the tubing hanger has properly landed in the tubing head spool.

17. The method as recited in claim 16, further comprising moving the tubing hanger toward the tubing head spool with a tubing hanger running tool.

18. The method as recited in claim 16, wherein using the landing surface comprises engaging the landing surface with a portion of the poppet stem extending from a valve body of the poppet valve.

19. The method as recited in claim 18, further comprising preventing interference with landing of the tubing hanger in the tubing head spool by forming the poppet stem with two pieces separated by a spring member.

* * * * *